US006688902B1

(12) United States Patent
Yoon et al.

(10) Patent No.: US 6,688,902 B1
(45) Date of Patent: Feb. 10, 2004

(54) RELEASABLE ELECTRICAL CONNECTOR FOR USE WITH CIRCUIT CARDS

(75) Inventors: Seunghyun Yoon, Upper Darby, PA (US); Keith D. Mease, Gibbstown, NJ (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/334,560

(22) Filed: Dec. 30, 2002

(51) Int. Cl.[7] ..... H01R 13/15
(52) U.S. Cl. ..... 439/260; 439/259
(58) Field of Search ..... 439/259, 260, 439/266, 267, 637, 681

(56) References Cited

U.S. PATENT DOCUMENTS 4,021,091 A * 5/1977 Anhalt et al. ..... 439/260
4,080,027 A * 3/1978 Benasutti ..... 439/260
4,390,224 A * 6/1983 Showman et al. ..... 439/264
4,392,700 A * 7/1983 Showman et al. ..... 439/260
4,428,635 A * 1/1984 Hamsher et al. ..... 439/265
6,283,778 B1 * 9/2001 Kupnicki et al. ..... 439/260

FOREIGN PATENT DOCUMENTS

JP 1-313864 * 12/1989 ..... 439/260
JP 2-21584 * 1/1990 ..... 439/260

* cited by examiner

*Primary Examiner*—Tho D. Ta
(74) *Attorney, Agent, or Firm*—Lise A. Rode; Mark T. Starr; Gary M. Cohen

(57) ABSTRACT

An electrical connector is provided which can releasably engage a circuit card within a slot defined by the electrical connector. A camming mechanism is provided which includes a slide having a series of camming surfaces for cooperating with a corresponding series of follower surfaces associated with a pin holder. Longitudinal movement of the slide causes the cooperating surfaces to spread open card edge receiving portions of the slot, or to close down over the portions of the circuit card to be engaged. The electrical connector preferably has an opening in one end to allow a circuit card to enter the slot from the side, allowing circuit cards to be removed from or installed in a rack, frame or other chassis from the side. A key is provided to ensure correct alignment of the circuit card in the slot prior to closure of the release mechanism.

38 Claims, 6 Drawing Sheets

Fig. 14
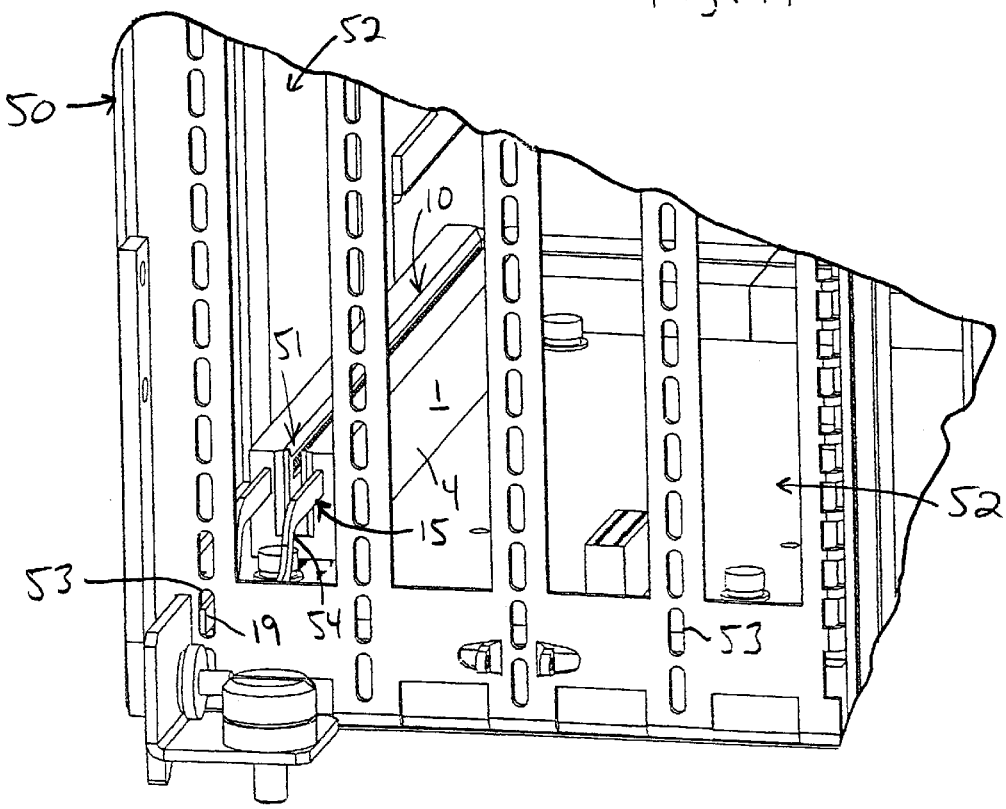
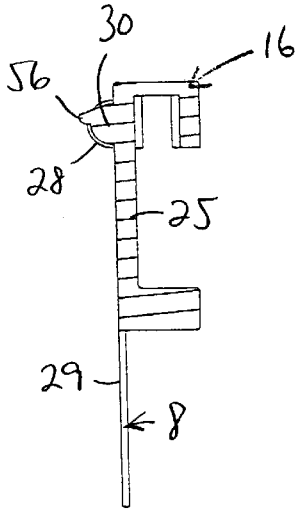
Fig. 16

RELEASABLE ELECTRICAL CONNECTOR FOR USE WITH CIRCUIT CARDS

BACKGROUND OF THE INVENTION

The present invention generally relates to electrical connectors, and more particularly, to electrical connectors for mating circuit cards and the like with frames, racks and other chassis for receiving such circuit cards.

Any of a variety of systems have been developed for receiving a series of circuit boards (i.e., circuit cards) in a frame, rack or other chassis. To this end, the frame, rack or receiving chassis is provided with a series of electrical connectors capable of mating with corresponding structures provided on the circuit cards. The resulting connections then operate to supply each circuit card with power for its operation, and to permit the exchange of data and any necessary operating signals.

In practice, it is generally necessary to combine a relatively large numbers of circuit cards in a single system to achieve a desired result. Over time, the need will arise to service the circuit cards, for example, to replace a circuit card which has become defective, to make an exchange with a circuit card having modified or upgraded capabilities, or to add a circuit card to or delete a circuit card from the overall system.

During such servicing procedures, it was traditionally necessary to remove power from, or "power down" the circuit cards to be serviced (removed or replaced) to protect the electrical systems associated with the circuit cards being serviced and/or other circuit cards associated with the system. This would often require a large number of circuit cards to be powered down to perform a desired servicing operation. This could, in turn, lead to a significant loss of function (system downtime) during the servicing procedure.

To minimize such losses of function during a desired servicing operation, so-called "hot plug" systems were developed. Such systems allow individual circuit cards to be addressed, and powered up and down from a central control unit. This then allows the individual circuit cards to be removed, replaced and/or added to the system without first having to take the system, or substantial portions of the system, off-line (i.e., powered down). As a result, portions of the system other than those requiring service can continue to operate during the servicing procedure, in this way minimizing losses of overall system function during such servicing. For this reason, hot plug technology has become an industry standard solution for providing users with increased system availability (reduced system downtime) and enhanced serviceability in various computing environments.

In operation, hot plug technology allows a single circuit card, for example, a PCI adapter card, to be isolated from the remainder of the system by isolating the PCI slot which is to receive the PCI card from other devices associated with the system. Isolation of the PCI slot includes the powering down of the (single) PCI slot, allowing the removal and/or insertion of a PCI card, and protection of the remaining elements of the system from potentially adverse electrical effects of the PCI card exchanges being made. The result is that the identified PCI card can be removed and/or inserted without interrupting the ongoing operations being performed by the remainder of the system.

Although such operations permit individual circuit cards to be removed and replaced while minimizing losses of function (system downtime) during the servicing procedure, it remains necessary to physically remove and insert the circuit cards during such servicing. Depending on the configuration of the frame, rack or chassis which receives the circuit cards, this can lead to some practical disadvantages.

For example, a common high availability solution for minimizing system downtime in industry-standard servers uses hot plug technology in conjunction with a mounting rack for receiving plural PCI adapter cards. Slots for receiving the PCI adapter cards are defined by electrical connectors which are physically connected to the rack, and which include a series of pins extending along opposing sides of the slot defined by the electrical connector for establishing electrical connections with a corresponding series of pads provided on the surfaces of the PCI adapter cards (i.e., along the "card edge"). The edge of the PCI adapter card having the series of pads can then be frictionally engaged within the slot of one of the electrical connectors, and between the series of pins, establishing necessary electrical connections with the electrical connector and the remainder of the system, and retaining the PCI adapter card in desired position.

To remove a PCI adapter card, the card is grasped (by hand or using a tool) and pulled from the electrical connector. To install a PCI adapter card, the edge of the PCI adapter card having the series of pads is aligning with the slot defined by the electrical connector, and the aligned card edge is inserted into the slot so that the pads on the card edge are engaged by the pins of the electrical connector.

Depending upon the orientation of the PCI adapter card and the electrical connector (horizontal, vertical, etc.), and the structural elements comprising the rack, access to the PCI adapter card can at times be limited. Consequently, while hot plug technology can operate to temporarily deactivate a PCI slot which is to be accessed, the amount of time and difficulty in physically accessing the PCI adapter card remains limited by the relative inconvenience of accessing a particular slot.

To help minimize this inconvenience, the PCI adapter cards and the slots (connectors) which are to receive them are often grouped together in a so-called "module box" which is removably mated with the rack. The module box can then be pulled from the rack to expose the PCI adapter cards it contains for servicing. In conjunction with hot plug technology, the PCI adapter cards associated with the module box are isolated, for servicing, while the remainder of the system remains powered.

While this facilitates access to the PCI adapter card which is to be serviced, this then leads to a corresponding disadvantage that the remaining PCI adapter cards associated with the module box are also deactivated when the module box is removed from the rack, giving rise to a potential loss of function. Consequently, the need remains for an electrical connector which can receive circuit cards in a manner which permits individual circuit cards to be accessed for service, independently of other circuit cards associated with the system and without interrupting operations of the other circuit cards associated with the system.

Irrespective of the configuration of the rack (frame or chassis) which is used to receive the PCI adapter cards, the frictional engagement which is maintained between the card edge and the electrical connector will, over time, tend to cause these components to wear as a result of repeated servicing operations. Consequently, the need remains for an electrical connector which can receive circuit cards in a manner which reduces the amount of friction developed between the engaged card edge and the electrical connector, to increase the overall durability and service life of both the card edge and the electrical connector.

SUMMARY OF THE INVENTION

These and other disadvantages are overcome by providing an electrical connector which can releasably engage a circuit card within a slot defined by the electrical connector. As is conventional, frictional engagement is developed between the circuit card and the electrical connector to establish desired electrical connections between the circuit card and the electrical connector, and to retain the circuit card in desired position. In accordance with the present invention, the electrical connector includes a release mechanism for removing the frictional engagement developed between the circuit card and the electrical connector, in this way allowing the circuit card to be freely removed from the slot of the electrical connector, or installed in the slot of the electrical connector, as desired.

In a preferred embodiment, a camming mechanism is mated with the slot of the electrical connector. The camming mechanism includes a slide having a series of camming surfaces which can cooperate with a corresponding series of follower surfaces associated with a pin holder. Longitudinal movement of the slide causes the cooperating camming and follower surfaces to spread open card edge receiving portions of the slot of the electrical connector. This then allows the appropriate portions of the circuit card (i.e., the card edge and pads of a PCI adapter card) to enter the slot substantially free of frictional engagement with the slot and the pins of the electrical connector. The slide is then returned to its initial position to cause the spread open portions of the electrical connector to close down over the portions of the circuit card which are to be engaged, establishing desired electrical connections and frictionally engaging the circuit card within the slot of the electrical connector.

The electrical connector of the present invention is preferably provided with an opening in an end of the connector body to allow a circuit card to enter the slot defined by the electrical connector from the side. The release mechanism can then be used to spread open the card edge receiving portions of the slot of the electrical connector, allowing the circuit card to move freely, and allowing a circuit card to be withdrawn from the slot or introduced into the slot from the side of the electrical connector.

A plurality of the electrical connectors of the present invention can advantageously be mated with a conventional frame, rack or other chassis to allow circuit cards to be removed from and installed in the electrical connectors from the side. The opening in the end of the connector body allows a circuit card to be removed or installed from the side, through an opening provided in the rack, frame or chassis which houses the circuit card. This allows the circuit cards housed in the rack, frame or chassis (e.g., in a PCI module box associated with a rack) to be replaced independently of other circuit cards, if desired, while the system comprised of the remaining circuit cards is operational (i.e., a hot plug system).

To facilitate the alignment of circuit cards, such as PCI adapter cards, within the slots of the receiving electrical connectors, conventional practice is to provide the edges of the PCI adapter cards which are to be installed with recesses which are positioned to mate with corresponding structures associated with the slot of the electrical connector. To facilitate the removal of circuit cards from, and the installation of circuit cards in the slot of the electrical connector of the present invention, particularly in cases where the circuit card is to be removed or installed from the side, a key, and preferably an opposing pair of keys, is operatively coupled with the release mechanism, for cooperation with the recesses which are conventionally formed in the circuit cards to align the circuit card in the slot prior to closure of the release mechanism. The keys are coupled with the release mechanism so that closure of the release mechanism causes the keys to move toward the recess of the circuit card, facilitating alignment between the two structures and allowing the release mechanism to be closed only upon correct alignment between the recess of the circuit card and the slot of the electrical connector. As alternatives, such alignment can also be accomplished using an optical or electrical circuit placed for alignment with the recesses provided in the circuit cards.

For further detail regarding preferred embodiments of the present invention, reference is made to the detailed description which is provided below, taken in conjunction with the following illustrations.

BRIEF DESCRIPTION OF THE DRAWINGS

FIG. 14 is an isometric view showing a module box incorporating the electrical connector of the present invention, viewed from the front of the module box.

FIG. 16 is a cross-sectional view of one of the pin holders, viewed along the line 16—16 shown in FIG. 9.

DETAILED DESCRIPTION OF THE INVENTION

Figure 1:
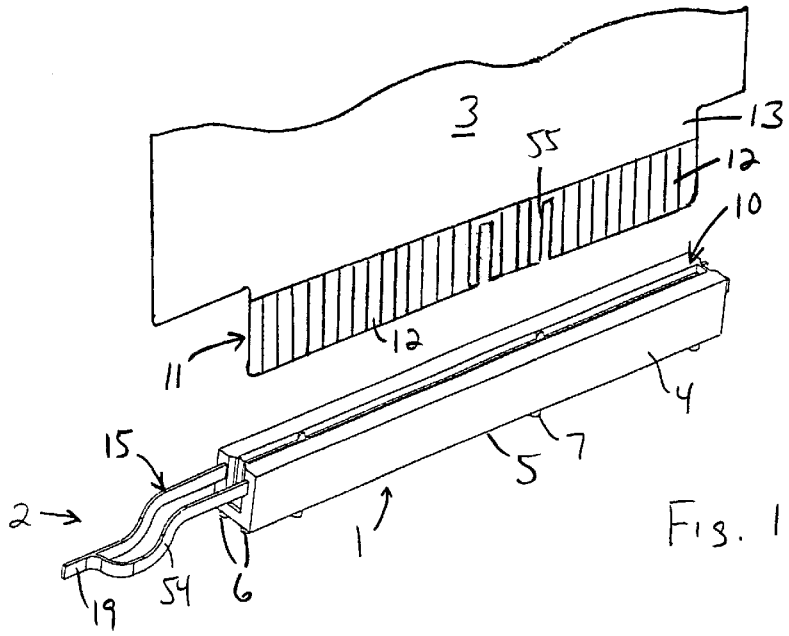
FIG. 1 is an isometric view of a preferred embodiment of the electrical connector of the present invention, together with a typical circuit card aligned to mate with the electrical connector.

FIG. 1 shows a preferred embodiment of an electrical connector 1 having a release mechanism 2 for releasably engaging a circuit card 3. The circuit card 3 selected for illustration in the drawings is a PCI adapter card, which is itself conventional and well known in the industry, and the electrical connector 1 has been configured to mate with this illustrative PCI adapter card. It is to be understood that a PCI adapter card has been selected for illustrative purposes only and that the electrical connector of the present invention can be modified to cooperate with other types of circuit cards, as desired.

Figure 2:
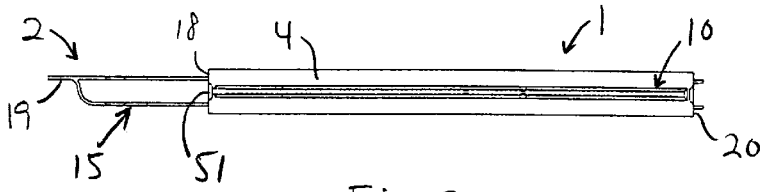
FIG. 2 is a top plan view of the electrical connector shown in FIG. 1.
Figure 3:
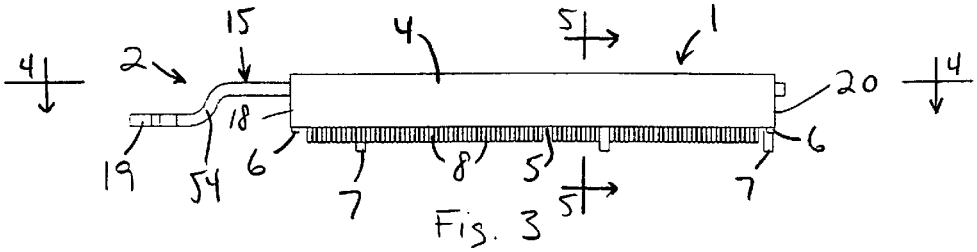
FIG. 3 is a side elevational view of the electrical connector shown in FIG. 1.

Referring to FIGS. 1 to 3, the electrical connector 1 is generally comprised of a connector body 4 having an overall size, shape and configuration suitable for being mated with a desired circuit, rack, frame or other circuit receiving chassis. To this end, the base 5 of the connector body 4 is provided with projecting structures for mounting the electrical connector 1 to the rack, frame or chassis with which it is to be associated, and for establishing desired electrical connections with electrical circuitry associated with the rack, frame or chassis. This can include, but is not limited to, desired structural supports (legs 6 and guides 7) and electrical attachments (pins 8), as shown in the figures, or other desired structures for interacting with the circuit, rack, frame or chassis which is to receive the electrical connector 1, as desired.

The connector body 4 further defines a slot 10 for receiving the circuit card 3. As is conventional, the slot 10 extends longitudinally along the center of the connector body 4, and has a width which substantially corresponds to the thickness of the circuit card 3 so that an edge 11 of the circuit card 3 can slidingly enter the slot 10. The pins 8 which project from the base 5 of the connector body 4 extend upwardly, through the connector body 4, and are aligned within the connector body 4 to establish electrical connections with the circuit card 3. To this end, the edge 11 of the circuit card 3 is provided with a series of pads 12, which are formed of an electrically conducting material and which are generally provided on opposing sides 13 of the card edge 11, to establish desired electrical connections between the pads 12 and the pins 8 as the card edge 11 enters the slot 10.

Conventional practice is to provide the slot 10 with a width, and to provide the opposing series of pins 8 with a separation (within the body 4) which will slidingly and frictionally engage the card edge 11, and the pads 12 associated with the card edge 11, within the slot 10 and between the opposing series of pins 8. The frictional engagement developed between the circuit card 3 and the electrical connector 1 establishes the desired electrical connections between the circuit card 3 and the electrical connector 1, and retains the circuit card 3 in desired position. To remove the circuit card 3 from the electrical connector 1, the circuit card 3 is grasped (by hand or using a tool) and pulled from the electrical connector 1, overcoming the frictional engagement present between the pins 8 and the pads 12. To install a circuit card 3, the edge 11 of the circuit card 3 is aligning with the slot 10, and the aligned card edge 11 is inserted into the slot 10 so that the pads 12 are frictionally engaged by the pins 8 of the electrical connector 1.

In accordance with the present invention, the release mechanism 2 operates to separate, or spread open the opposing series of pins 8, to substantially eliminate the frictional forces developed between the pads 12 of the circuit card 3 and the pins 8 of the electrical connector 1. This then allows the circuit card 3 to be freely removed from the slot 10 of the electrical connector 3, or installed in the slot 10 of the electrical connector 3, as desired.

Figure 4:
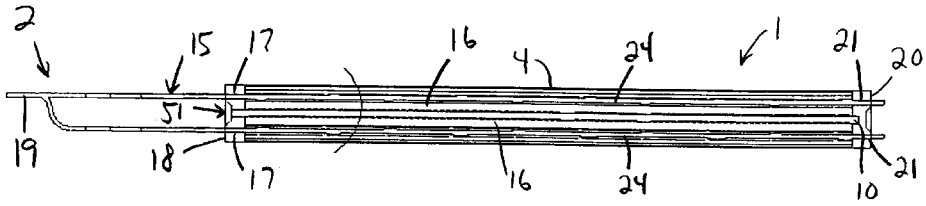
FIG. 4 is a cross-sectional view of the electrical connector shown in FIG. 1, viewed along the line 4—4 shown in FIG. 3.
Figure 5:
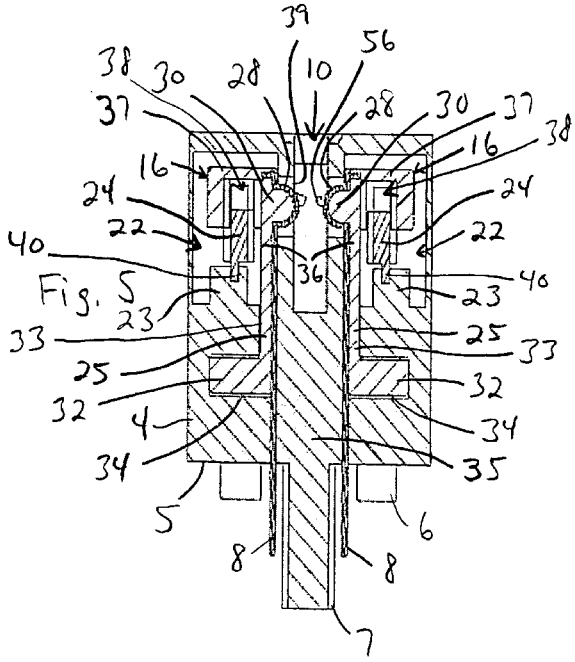
FIG. 5 is a cross-sectional view of the electrical connector shown in FIG. 1, viewed along the line 5—5 shown in FIG. 2.

Referring now to FIGS. 4 and 5, the release mechanism 2 generally includes a slide 15 coupled with a pair of pin holders 16. The slide 15 and the pin holders 16 each extend longitudinally through the connector body 4.

One end of the slide 15 projects through a pair of correspondingly configured openings 17 formed in one end 18 of the connector body 4, and defines a handle 19 which can be grasped to advance and retract the slide 15 as will be discussed more fully below. The opposing end of the slide 15 exits the other end 20 of the connector body 4 thought a pair of correspondingly configured openings 21. The connector body 4 includes a pair of cavities 22, for receiving the pin holders 16 as will be described more fully below. Each of the cavities 22 is provided with a track 23 for slidingly receiving, guiding and supporting each of a pair of longitudinal arms 24 which form the slide 15.

Figure 6:
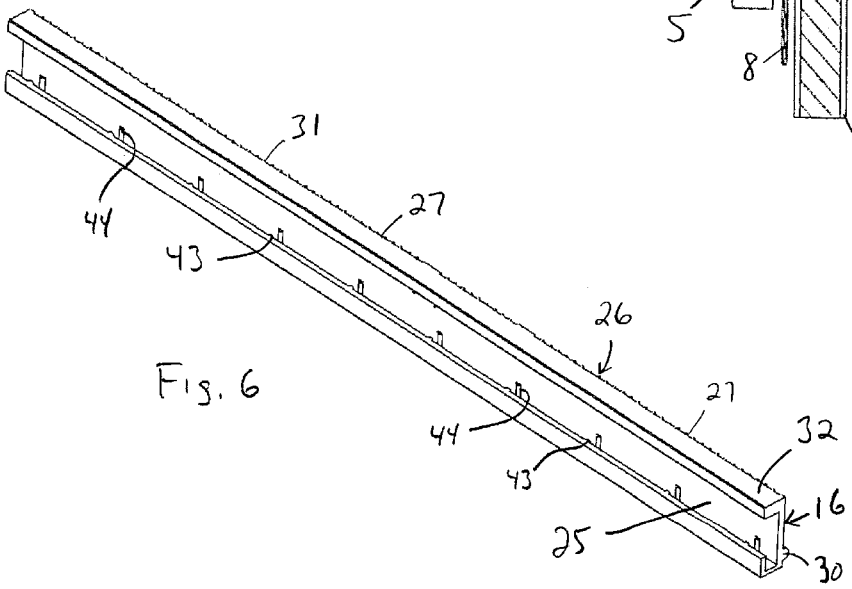
FIG. 6 is an isometric view of one of the pin holders associated with the electrical connector, viewed from the bottom of the pin holder.
Figure 7:
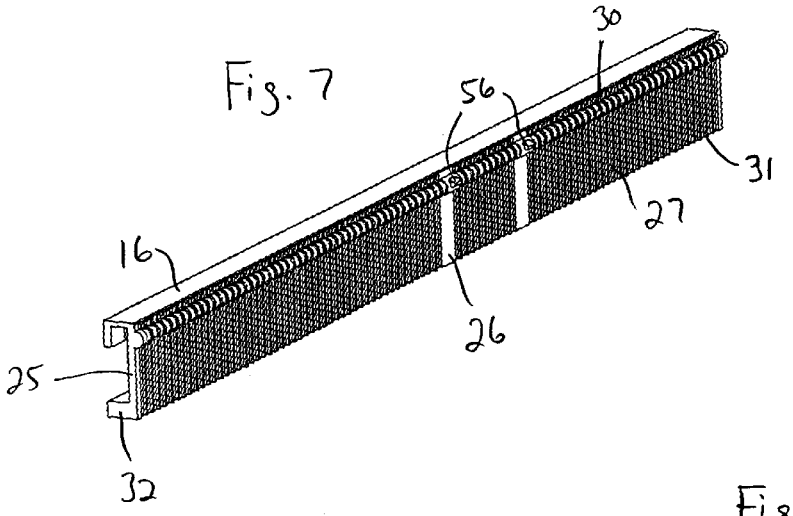
FIG. 7 is an isometric view of one of the pin holders associated with the electrical connector, showing the pin receiving grooves.
Figure 8:
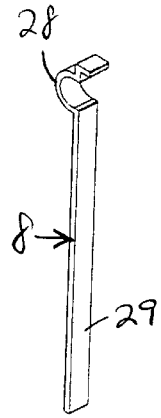
FIG. 8 is an isometric view of one of the pins associated with the pin holder.
Figure 9:
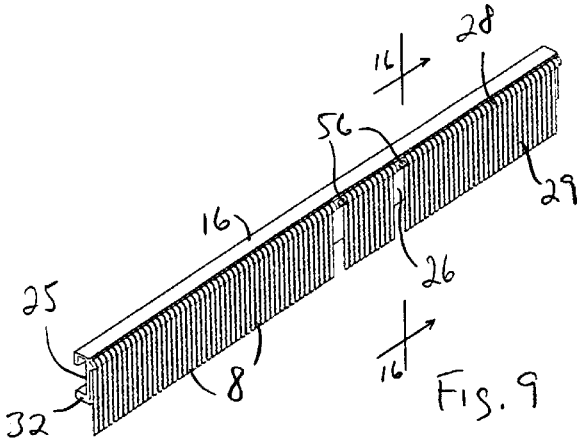
FIG. 9 is an isometric view of one of the pin holders associated with the electrical connector, showing the pins mated with the grooves.

Referring now to FIGS. 6 and 7, each of the pin holders 16 takes the form of a generally U-shaped structure, and includes a web 25 for receiving a series of the pins 8. To this end, the outer face 26 of the web 25 is provided with a series of grooves 27, each sized to receive one of the pins 8. FIG. 8 shows one of the pins 8, having a semi-circular contact portion 28 for establishing an electrical connection with one of the pads 12 of the circuit card 3, and an electrically conductive body 29 for projecting from the base 5 of the connector body 4 as previously described. The contact portion 28 mates with a correspondingly configured projection 30 associated with each of the grooves 27 formed in the outer face 26 of the web 25. The grooves 27 are separated by a series of ribs 31, defining the individual grooves 27 for receiving the pins 8 (both the contact portion 28 and the body 29). FIG. 9 shows a series of pins 8 mated with the grooves 27 in the outer face 26 of one of the pin holders 16.

The pair of pin holders 16 are formed as mirror images of each other, and substitute for the fixed surfaces which were previously used to receive the opposing series of pins associated with a conventional electrical connector. A first flange 32 projects from an end 33 of the web 25. The flange 32, and the end 33 of the web 25 of each of the pin holders 16, is received within an L-shaped cavity 34 formed in the connector body 4. The L-shaped cavity operates to securely retain each pin holder 16 within the connector body 4, and against a center support 35 which includes the slot 10 for receiving the card edge 11. To be noted is that this leaves an opposing end 36 of each web 25 free for transverse movement relative to the slot 10, within the cavities 22.

A second flange 37 projects from the end 36 of the web 25 of each pin holder 16, extending over the arms 24 of the slide 15 and receiving the arms 24 within a channel 38 defined by each flange 37. The contact portions 28 of the pins 8, which are also associated with the ends 36 of the webs 25, are aligned with and are configured to pass through a window 39 which communicates with the slot 10. Interaction between the arms 24 of the slide 15 and the channels 38 of the pin holders 16 can then operate to either urge the contact portions 28 of the pins 8 into the slot 10, or to draw the flanges 37 into the cavities 22 of the connector body 4, withdrawing the contact portions 28 of the pins 8 from the slot 10.

Urging the contact portions 28 of the pins 8 into the slot 10 operates to securely engage the edge 11 and the pads 12 of the circuit card 3, establishing desired electrical connections and securely retaining the circuit card 3 within the slot 10. Withdrawal of the contact portions 28 of the pins 8 from the slot 10 operates to spread open and separate the series of pins 8 associated with the opposing pin holders 16, to free the edge 11 of the circuit card 3 either for removal from, or insertion into the slot 10. This then allows the card edge 11 to slidingly enter or exit the slot 10, without frictional interference with the pins 8 of the electrical connector 1.

Preferred structures for developing the interaction between the slide 15 and the pin holders 16 which is used to spread the series of pins 8, for insertion of the card edge 11, and to close the series of pins 8 down over the inserted card edge 11, are shown with reference to FIGS. 5, 6, 10 and 11.

Figure 11:
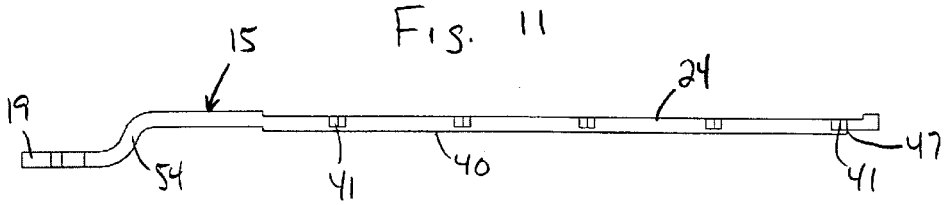
FIG. 11 is a side elevational view of the slide of the electrical connector shown in FIG. 1.
Figure 10:
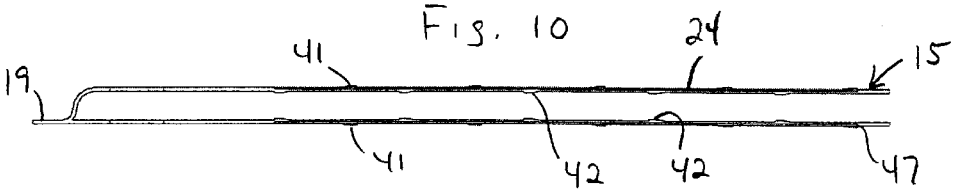
FIG. 10 is a top plan view of the slide of the electrical connector shown in FIG. 1.

FIGS. 10 and 11 show the slide 15 in greater detail, including the handle 19 for grasping the slide 15 and the arms 24 which are to interact with the pin holders 16. Each of the arms 24 includes a rail portion 40, which is received in one of the tracks 23 associated with the cavities 22 in the connector body 4. Each rail portion 40 further includes a series of projections 41, 42, on opposing sides of the rail portion 40, which are preferably placed at spaced locations along the rail portions 40. Referring now to FIGS. 5 and 6, the channels 38 associated with each of the pin holders 16 further includes a series of projections 43, 44, which are similarly positioned on opposing sides of the channels 38, and which are preferably placed at spaced locations along the channels 38 for cooperating with the projections 41, 42 of the slide 15.

Figure 12:
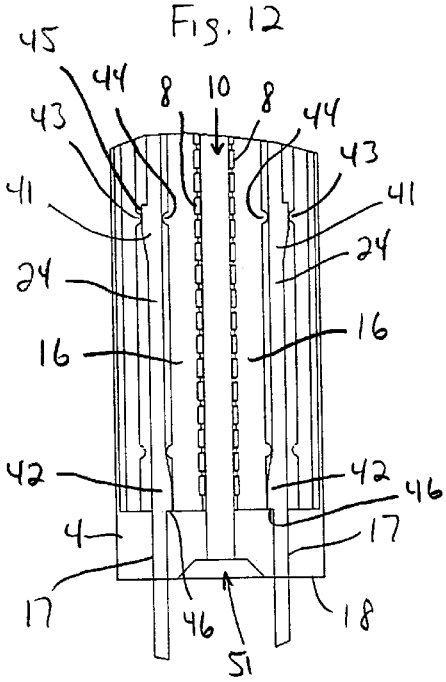
FIG. 12 is an enlarged, partial cross-sectional view of the electrical connector, similar to FIG. 4, and showing full retraction of the slide.
Figure 13:
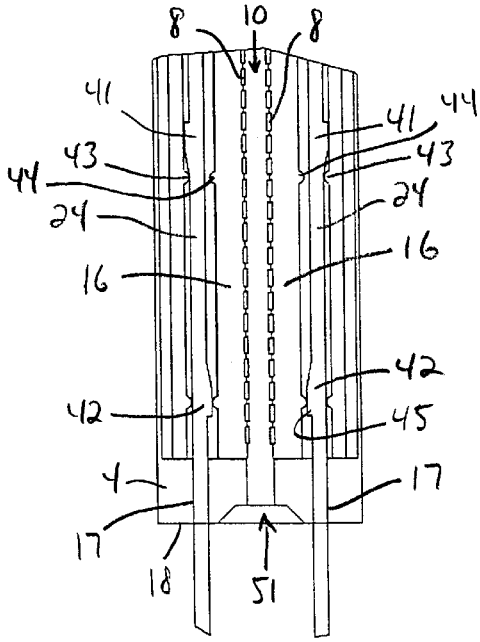
FIG. 13 is an enlarged, partial cross-sectional view of the electrical connector, similar to FIG. 4, and showing full advancement of the slide.

Referring now to FIGS. 12 and 13, assume that the removal of a circuit card, or the installation of a circuit card, is to be performed. To "open" the slot 10 of the electrical connector 1, the handle 19 of the slide 15 is grasped and pulled outwardly from the connector body 4. This will cause retraction of the slide 15, advancing the arms 24 bearing the projections 41, 42 toward the end 18 of the connector body 4.

The projections 41, 42 of the slide 15 are preferably formed as inclined surfaces, and the projections 43, 44 of the pin holders 16 are preferably formed as semi-circular surfaces, providing opposing camming and follower surfaces for interaction with each other. Retraction of the slide 15 will draw the outwardly facing projections 41 on the slide 15 into engagement with the outer projections 43 provided on each of the pin holders 16. This will, in turn, operate to draw the flanges 37 of the pin holders 16 outwardly, drawing the contact portions 28 of the pins 8 out of the slot 10, as previously described. The projections 41 are preferably provided with flat portions 45, to establish stable regions for maintaining such interaction between the projections 41 and the opposing projections 43. A step 46 formed in the projection 42 closest to the end 18 preferably serves as a stop capable of indicating when the slide 15 has been fully retracted and that the projections 41 have been aligned with the projections 43. A circuit card can then be freely removed from or inserted into the slot 10, without encountering the pins 8, and as result, without encountering any significant friction or insertion forces.

Following the insertion of a circuit card into the slot 10 of the electrical connector 1, and referring now to FIG. 13, the handle 19 of the slide 15 is again grasped and pushed into the connector body 4 to "close" the slot 10 over the inserted circuit card. This will cause the slide 15 to advance the arms 24 bearing the projections 41, 42 toward the end 20 of the connector body 4.

Such advancement of the slide 15 will operate to draw the outwardly facing projections 41 on the slide 15 out of engagement with the outer projections 43 provided on each of the pin holders 16, and to draw the inwardly facing projections 42 on the slide 15 into engagement with the inner projections 44 provided on each of the pin holders 16. This will, in turn, operate to draw the ends 36 of the webs 25 of the pin holders 16 inwardly, drawing the contact portions 28 of the pins 8 into the slot 10 and into engagement with the pads on the circuit card as previously described. This will also operate to secure the circuit card in the slot 10. The resiliency of the webs 25 will assist in drawing the contact portions 28 into engagement with the pads on the circuit card, acting as a return spring for the pin holders 16. Steps 47 formed in the arms 24 of the slide 15 (see FIGS. 10 and 11) preferably serve as a stop capable of engaging the end 20 of the connector body 4, to in this way indicate when the slide 15 has been fully advanced into the connector body 4 and that the projections 42 have been aligned with the projections 44.

The electrical connector 1 can be used in any of a variety of applications, to effectively interact with any of a variety of circuit cards. One or more of the electrical connectors 1 can be mated with any of a variety of frames, racks or other chassis, to provide any of a variety of circuit forming configurations. One such application to which the electrical connector 1 is particularly well suited is hot plug technology, where it is desirable to access and to replace circuit cards associated with a system independently of other circuit cards and while the overall system remains active and operational.

Figure 15:
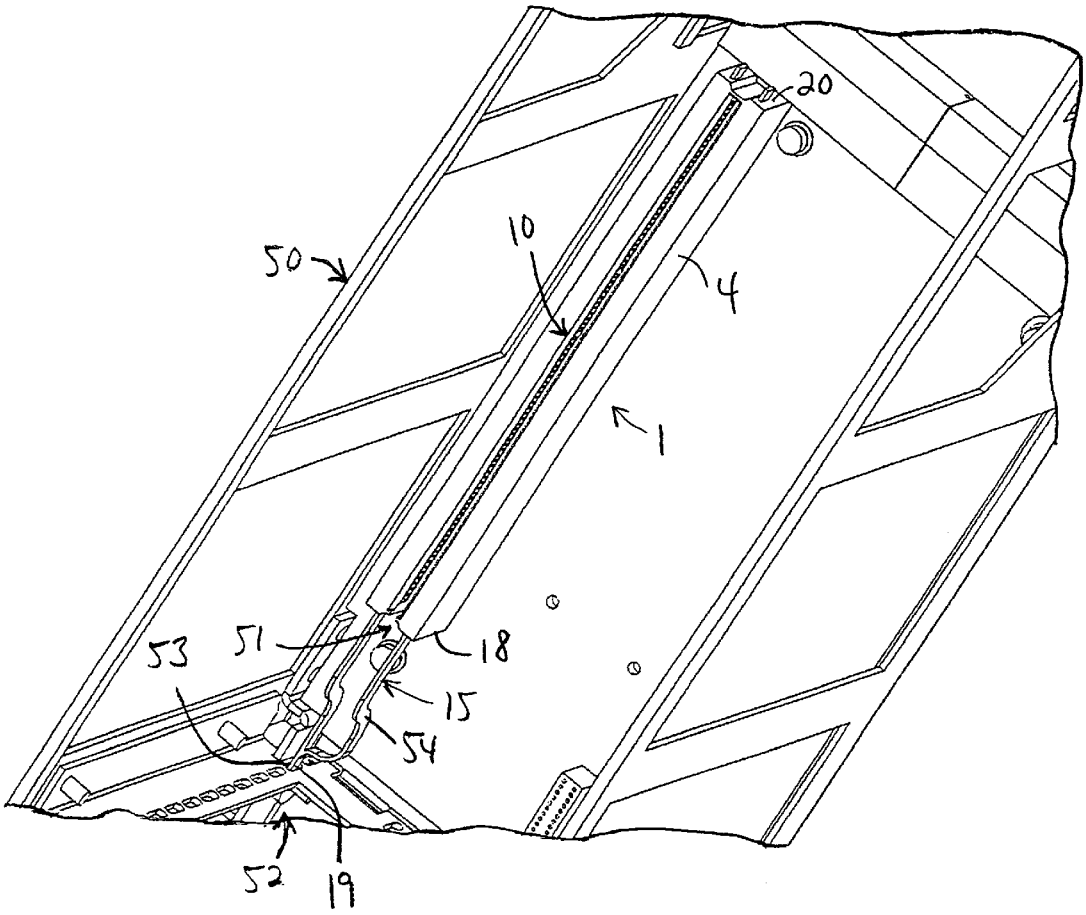
FIG. 15 is an isometric view showing the module box of FIG. 14 from the top.

Referring now to FIGS. 14 and 15, portions of a typical rack configuration which is adapted for use with hot plug technology are shown. In particular, one of what will typically comprise a large number of module boxes is shown, removed from the overall rack (not shown) which receives the module boxes. Conventional practice is for the circuit card to be serviced (removed and/or inserted) to be identified and isolated from the remainder of the system. The module box, which is removably mated with the rack, is then pulled from the rack to expose the identified circuit card for servicing (i.e., removal and/or insertion through the top of the withdrawn module box). Because the withdrawn module box typically holds other circuit cards, the remaining circuit cards associated with the module box will then also be deactivated, resulting from the removal of the module box from the rack.

In accordance with the present invention, each of a plurality of circuit cards can be individually accessed, independently of any other circuit cards associated with the module box 50, using the electrical connector 1 previously described. Only one electrical connector 1 is shown mated with the module box 50, for simplification of the drawings. Remaining spaces, for receiving other circuit cards, would preferably be similarly fitted with an electrical connector 1.

To avoid the need to have to access circuit cards associated with the module box 50 from the top, each of the electrical connectors 1 is preferably provided with an opening 51 in the end 18 of the connector body 4. The opening 51 is sized to slidingly receive the edge 11 of a circuit card 3 (see FIG. 1), allowing the circuit card to laterally enter the slot 10. This, in turn, allows the circuit card to be drawn from, or introduced into the slot 10 from the side of the module box 50, rather than from the top. To this end, the module box 50 is preferably provided with side openings 52, for receiving the circuit cards, and openings 53 for receiving the handle 19 of the slide 15 of the electrical connector 1. The handle 19 is additionally and preferably provided with the curvatures 54 which are shown (see, also, FIG. 11) to allow a circuit card to freely pass between the slot 10 and the opening 52.

In use, a circuit card to be withdrawn from the electrical connector 1 associated with the module box 50 is first isolated from the remainder of the system, by the hot plug technology, as is conventional. The module box 50 housing the isolated electrical connector 1 need not be removed from the rack, and other circuit cards (not shown) associated with the module box 50 can remain active.

To remove a circuit card from the isolated electrical connector 1, the handle 19 of the slide 15 extending through the opening 53 is grasped and pulled out. This then draws the contact portions 28 of the pins 8 associated with the electrical connector 1 from the slot 10, freeing any circuit card then located in the slot 10. The circuit card then in the slot 10 is grasped and drawn from the slot 10. To this end, the card edge 11 will freely pass through the opening 51 and the circuit card will freely pass through the opening 52.

To install a circuit card in the electrical connector 1, the circuit card is passed through the opening 52 so that the card edge 11 is in alignment with the opening 51. The card edge 11 is then inserted through the opening 51, entering the slot 10 from the side. After the card edge 11 has been fully inserted into the slot, the handle 19 of the slide 15 is pushed toward the electrical connector 1, moving the contact portions 28 of the series of pins 8 into engagement with the installed circuit card. This then operates to secure the circuit card within the electrical connector 1, and to establish desired electrical connections with the pads 12 on the card edge 11. The electrical connector 1 can then be activated by the hot plug technology, placing the installed circuit card in service.

To facilitate the alignment of card edges relative to the slots of conventional electrical connectors, circuit cards such as PCI adapter cards are traditionally provided with recesses 55 (see FIG. 1) which are positioned to mate with corresponding structures associated with the slot of the electrical connector. To facilitate the removal of circuit cards from, and the installation of circuit cards into the slot 10 of the electrical connector 1 of the present invention, particularly in cases where the circuit card is to be removed or installed from the side, the slot 10 must be clear of structures for mating with the recesses 55. As a substitute for the removed structures for mating with the recesses 55, the electrical connector 1 of the present invention is preferably provided with a position indicator for effectively locating a circuit card in the slot 10 which is to receive it. Such a position indicator can facilitate the insertion of a circuit card into the slot 10 of the electrical connector 1 from the top, or from the side, and is preferable to relying on the interaction of physical structures (e.g., card edges and slot edges) for the effective location of a circuit card as it enters the slot 10.

Referring now to FIGS. 5 and 16, a preferred position indicator for interacting with the recess 55 of a circuit card being installed in the slot 10 of an electrical connector 1 of the present invention is implemented using a key 56, and preferably an opposing pair of keys 56, which are coupled with the projections 30 of the pin holders 16 which will be aligned with the recess 55 of the card edge when the circuit card is correctly positioned in the slot 10.

In operation, advancement of the slide 15 toward the connector body 4 to close the pins 8 over the circuit card to be installed will cause the pin holders 16 to be urged toward each other responsive to interaction between the projections 42 of the slide 15 and the projections 44 of the pin holders 16. As the pin holders 16 are urged toward each other, the keys 56 will be drawn together, in advance of the closing pins 8. If the circuit card is correctly positioned in the slot 10, the recess 55 in the card edge will be aligned with the advancing keys 56. The keys 56 will then be received in the recess 55, allowing the pin holders 16 to continue to advance and close over the aligned card edge, and allowing the slide 15 to be fully advanced into the connector body 4 (i.e., to a fully closed position). If the circuit card is incorrectly positioned in the slot 10, the recess 55 in the card edge will not be aligned with the advancing keys 56, which will then prevent the pin holders 16 from advancing and closing over the incorrectly aligned card edge. The slide 15 will in such cases be prevented from fully advancing to the closed position, indicating that the circuit card has not yet been correctly positioned in the slot 10. As alternatives, such alignment can similarly be accomplished using an optical or electrical circuit placed for alignment with the recess 55 provided in the circuit card. Plural position indicating structures (e.g., the plural pairs of opposing keys 56 shown in FIGS. 7 and 9) can be employed in conjunction with plural recesses 55 formed in the circuit cards being installed, if desired.

It will, therefore, be understood that various changes in the details, materials and arrangement of parts which have been herein described and illustrated in order to explain the nature of this invention may be made by those skilled in the art within the principle and scope of the invention as expressed in the claims which follow. For example, the disclosed electrical connector 1 has an opposing pair of pin holders 16 positioned on opposite sides of the slot 10. It is also possible to employ only a single pin holder, if desired. Any opposing pins could then be mounted on fixed portions of the connector body, leaving the single pin holder to engage and disengage circuit cards as previously described. Other alternative embodiments will occur to the person of ordinary skill.

What is claimed is:

1. An electrical connector for receiving a circuit card having a card edge including a plurality of electrical contacts, the electrical connector comprising:

a body having portions for connecting the electrical connector to external circuit elements, a slot formed in the body for receiving the card edge, wherein the slot has a size which substantially corresponds to the card edge, and a plurality of pins associated with the slot and extending through the body, wherein the pins are positioned for engagement with the electrical contacts of the circuit card; and a release mechanism coupled with the body of the electrical connector and the pins associated with the slot, for urging the pins into the slot when the release mechanism assumes a first operating position, and for drawing the pins out of the slot when the release mechanism assumes a second operating position, the release mechanism including:

a slide extending longitudinally through the connector body, and extending along the slot, wherein the slide is movable between the first operating position and the second operating position; and a pin holder coupled with the slide and with the connector body, for transverse movement relative to the slot, wherein the pin holder includes a flange defining a channel for receiving the slide, and wherein the plurality of pins are attached to the pin holder.

2. The electrical connector of claim 1 wherein the release mechanism includes a pair of pin holders positioned on opposite sides of the slot, wherein the plurality of pins are attached to the pair of pin holders, and wherein each of the pin holder is coupled with the slide.

3. The electrical connector of claim 1 wherein the pins have electrical contacts positioned adjacent to the flange.

4. The electrical connector of claim 1 wherein the slide includes a handle portion extending from the connector body.

5. The electrical connector of claim 1 wherein the pin holder includes a plurality of projections extending into the channel, and wherein the slide includes an arm positioned in the channel and including a plurality of projections aligned for engagement with the projections extending into the channel.

6. The electrical connector of claim 5 wherein the projections on a side of the arm closest to the slot are aligned with the projections extending into a side of the channel closest to the slot when the release mechanism is in the first operating position, and wherein the projections on a side of the arm away from the slot are aligned with the projections extending into a side of the channel away from the slot when the release mechanism is in the second operating position.

7. The electrical connector of claim 5 wherein the projections extending into the channel and the projections of the arm are inclined surfaces forming cooperating camming and follower surfaces.

8. The electrical connector of claim 7 wherein the projections include flat portions forming a surface for stable engagement with opposing projections.

9. The electrical connector of claim 1 wherein the body includes a cavity for receiving the slide and the pin holder, and which further includes a track formed in the cavity for receiving portions of the slide.

10. The electrical connector of claim 9 wherein the portions of the slide received by the track are coupled with the pin bolder.

11. The electrical connector of claim 1 wherein the slot extends longitudinally between opposing ends of the connector body, wherein the electrical connector further includes an opening formed in one of the ends of the connector body, and wherein the opening has a size which substantially corresponds to the card edge, for slidingly receiving the circuit card in the slot through the opening.

12. The electrical connector of claim 11 wherein the release mechanism includes a handle portion extending from the connector body, and wherein the handle portion has a curvature for allowing the card edge to pass the handle.

13. The electrical connector of claim 11 wherein the release mechanism further includes a key positioned to project into the slot, wherein the key is positioned for alignment with a recess formed in the card edge.

14. The electrical connector of claim 13 wherein the release mechanism can assume the first operating position only when the recess of the card edge is in alignment with the key.

15. An electrical connector for receiving a circuit card having a card edge including a plurality of electrical contacts, the electrical connector comprising:

a body having portions for connecting the electrical connector to external circuit elements, a slot formed in the body for receiving the card edge, wherein the slot has a size which substantially corresponds to the card edge, and a plurality of pins associated with the slot and extending through the body, wherein the pins are positioned for engagement with the electrical contacts of the circuit card;

a slide extending longitudinally through the connector body, and extending along the slot, wherein the slide is movable between the first operating position and the second operating position; and a pin holder receiving the plurality of pins and coupled with the slide and with the connector body, for transverse movement relative to the slot responsive to movement of the slide between the first operating position and the second operating position, wherein the pin holder includes a flange defining a channel for receiving the slide.

16. The electrical connector of claim 15 wherein the pin holder is moved toward the slot when the slide is in the first operating position, and wherein the pin holder is moved away from the slot when the slide is in the second operating position.

17. The electrical connector of claim 15 which includes a pair of pin holders positioned on opposite sides of the slot, wherein the plurality of pins are attached to the pair of pin holders, and wherein each of the pin holder is coupled with the slide.

18. The electrical connector of claim 15 wherein the pins have electrical contacts positioned adjacent to the flange.

19. The electrical connector of claim 15 wherein the slide includes a handle portion extending from the connector body.

20. The electrical connector of claim 15 wherein the pin holder includes a plurality of projections extending into the channel, and wherein the slide includes an arm positioned in the channel and including a plurality of projections aligned for engagement with the projections extending into the channel.

21. The electrical connector of claim 20 wherein the projections on a side of the arm closest to the slot are aligned with the projections extending into a side of the channel closest to the slot when the slide is in the first operating position, and wherein the projections on a side of the arm away from the slot are aligned with the projections extending into a side of the channel away from the slot when the slide is in the second operating position.

22. The electrical connector of claim 20 wherein the projections extending into the channel and the projections of the arm are inclined surfaces forming cooperating camming and follower surfaces.

23. The electrical connector of claim 22 wherein the projections include flat portions forming a surface for stable engagement with opposing projections.

24. The electrical connector of claim 15 wherein the body includes a cavity for receiving the slide and the pin holder, and which further includes a track formed in the cavity for receiving portions of the slide.

25. The electrical connector of claim 24 wherein the portions of the slide received by the track are coupled with the pin holder.

26. The electrical connector of claim 15 wherein the slot extends longitudinally between opposing ends of the connector body, wherein the electrical connector further includes an opening formed in one of the ends of the connector body, and wherein the opening has a size which substantially corresponds to the card edge, for slidingly receiving the circuit card in the slot through the opening.

27. The electrical connector of claim 26 wherein the release mechanism includes a handle portion extending from the connector body, and wherein the handle portion has a curvature for allowing the card edge to pass the handle.

28. The electrical connector of claim 15 which further includes a key coupled with the pin holder and projecting from the pin holder toward the slot, wherein the key is positioned for alignment with a recess formed in the card edge.

29. The electrical connector of claim 28 wherein the slide can assume the first operating position only when the recess of the card edge is in alignment with the key.

30. A module box incorporating an electrical connector for receiving a circuit card having a card edge including a plurality of electrical contacts, wherein the electrical connector comprises:

a body having portions connecting the electrical connector to the module box, the connector body having a slot that extends longitudinally between opposing ends of the connector body for receiving the card edge and having a size which substantially corresponds to the card edge, wherein an opening is formed in one of the ends of the body, the opening having a size that substantially corresponds to the card edge for slidingly receiving the circuit card in the slot, the body further having a plurality of pins associated with the slot and extending through the body, wherein the pins are positioned for engagement with the electrical contacts of the circuit card;

a slide extending longitudinally through the connector body, and extending along the slot, wherein the slide is movable between the first operating position and the second operating position; and a pin holder receiving the plurality of pins and coupled with the slide and with the connector body, for transverse movement relative to the slot responsive to movement of the slide between the first operating position and the second operating position.

31. The module box of claim 30 wherein the pin holder is moved toward the slot when the slide is in the first operating position, and wherein the pin holder is moved away from the slot when the slide is in the second operating position.

32. The module box of claim 30 which includes a pair of pin holders positioned on opposite sides of the slot, wherein the plurality of pins are attached to the pair of pin holders, and wherein each of the pin holder is coupled with the slide.

33. The module box of claim 30 wherein the slide includes a handle portion extending from the connector body.

34. The module box of claim 30 which further includes plural electrical connectors for receiving plural circuit cards.

35. The module box of claim 30 wherein the electrical connector is free of structure for interfering with movement of the circuit card within the slot when the slide is in the second operating position.

36. The module box of claim 35 wherein the slide includes a handle portion extending from the connector body, and wherein the handle portion has a curvature for allowing the card edge to pass the handle.

37. The module box of claim 35 which further includes a key coupled with the pin holder and projecting from the pin holder toward the slot, wherein the key is positioned for alignment with a recess formed in the card edge.

38. The module box of claim 37 wherein the slide can assume the first operating position only when the recess of the card edge is in alignment with the key.

* * * * *